US009066399B2

(12) United States Patent
Park et al.

(10) Patent No.: US 9,066,399 B2
(45) Date of Patent: Jun. 23, 2015

(54) ILLUMINATION DRIVING APPARATUS FOR LIGHT EMITTING DIODE AND METHOD THEREOF

(71) Applicants: SAMSUNG ELECTRO-MECHANICS CO., LTD., Suwon, Gyunggi-do (KR); UNIVERSITY OF SEOUL INDUSTRY COOPERATION FOUNDATION, Seoul (KR)

(72) Inventors: Deuk Hee Park, Gyunggi-do (KR); Joong Ho Choi, Gyunggi-do (KR); Sang Hyun Cha, Gyunggi-do (KR); Jae Shin Lee, Gyunggi-do (KR); Chang Seok Lee, Gyunggi-do (KR); Yun Joong Lee, Gyunggi-do (KR)

(73) Assignees: SAMSUNG ELECTRO-MECHANICS CO., LTD., Suwon-Si, Gyeonggi-Do (KR); UNIVERSITY OF SEOUL INDUSTRY COOPERATION FOUNDATION, Seoul (KR)

( * ) Notice: Subject to any disclaimer, the term of this patent is extended or adjusted under 35 U.S.C. 154(b) by 292 days.

(21) Appl. No.: 13/839,145

(22) Filed: Mar. 15, 2013

(65) Prior Publication Data

US 2014/0035473 A1 Feb. 6, 2014

(30) Foreign Application Priority Data

Jul. 31, 2012 (KR) ..... 10-2012-0084097

(51) Int. Cl.
*H05B 37/00* (2006.01)
*H05B 39/00* (2006.01)
(Continued)

(52) U.S. Cl.
CPC ..... *H05B 33/0845* (2013.01); *H05B 33/083* (2013.01)

(58) Field of Classification Search
USPC ..... 315/186, 119, 210
See application file for complete search history.

(56) References Cited

U.S. PATENT DOCUMENTS

2002/0140379 A1* 10/2002 Chevalier et al. ..... 315/291
2006/0227085 A1* 10/2006 Boldt et al. ..... 345/83
(Continued)

FOREIGN PATENT DOCUMENTS

JP 2007-123562 A 5/2007
JP 2012-123973 A 6/2012
(Continued)

OTHER PUBLICATIONS

Korean Office Action issued in Korean Application No. 10-2012-0084097 dated Jun. 23, 2014, w/English translation.
(Continued)

*Primary Examiner* — Adam Houston
(74) *Attorney, Agent, or Firm* — McDermott Will & Emery LLP

(57) ABSTRACT

There is provided an illumination driving apparatus for a light emitting diode, the apparatus including: a light emitting unit including M number of light emitting diodes (LEDs) connected in series and driven by an output voltage rectified in a rectifying unit; an LED switch unit including N number of LED switches connected in parallel with at least N number of the M LEDs, respectively, and connected in series; an LED switch control signal generating unit comparing the output voltage of the rectifying unit with each of the first to Nth preset reference voltages to generate N number of LED switch control signals controlling the LED switch unit; and an LED switch controlling unit transferring the N number of LED switch control signals to the LED switch unit.

23 Claims, 3 Drawing Sheets

(51) Int. Cl.
*H05B 41/00* (2006.01)
*H05B 33/08* (2006.01)

(56) References Cited

U.S. PATENT DOCUMENTS

| | | | | |
|---|---|---|---|---|
| 2007/0208975 | A1* | 9/2007 | Katti et al. | 714/727 |
| 2008/0265785 | A1* | 10/2008 | Kim | 315/169.3 |
| 2008/0266216 | A1* | 10/2008 | Choi | 345/77 |
| 2009/0087722 | A1* | 4/2009 | Sakabe et al. | 429/61 |
| 2009/0289559 | A1* | 11/2009 | Tanaka et al. | 315/185 R |
| 2011/0043764 | A1* | 2/2011 | Narikawa | 353/31 |
| 2011/0109228 | A1* | 5/2011 | Shimomura et al. | 315/113 |
| 2011/0169411 | A1* | 7/2011 | Inoue et al. | 315/82 |
| 2013/0169147 | A1* | 7/2013 | Ooya et al. | 313/503 |
| 2014/0035473 | A1* | 2/2014 | Park et al. | 315/186 |
| 2014/0160176 | A1* | 6/2014 | Nose et al. | 345/690 |
| 2014/0361696 | A1* | 12/2014 | Siessegger et al. | 315/186 |

FOREIGN PATENT DOCUMENTS

| | | | |
|---|---|---|---|
| KR | 10-2007-0009645 | A | 1/2007 |
| KR | 10-0942234 | B1 | 2/2010 |
| KR | 10-2011-0014252 | A | 2/2011 |
| WO | 2005/094300 | A2 | 10/2005 |

OTHER PUBLICATIONS

Notice of Office Action Korean Patent Application No. 10-2012-0084097 dated Nov. 15, 2014 with English translation.

* cited by examiner

ILLUMINATION DRIVING APPARATUS FOR LIGHT EMITTING DIODE AND METHOD THEREOF

CROSS-REFERENCE TO RELATED APPLICATIONS

This application claims the priority of Korean Patent Application No. 10-2012-0084097 filed on Jul. 31, 2012, in the Korean Intellectual Property Office, the disclosure of which is incorporated herein by reference.

BACKGROUND OF THE INVENTION

1. Field of the Invention

The present invention relates to an illumination driving apparatus for a light emitting diode and a method thereof capable of averaging illumination in the case of deterioration of light emitting diodes.

2. Description of the Related Art

Recently, an alternating current (AC) power supply has generally been used as a power supply for driving a light emitting diode. However, when a light emitting diode is driven using the AC power supply, a circuit for converting AC power into direct current (DC) power, a constant current source circuit for driving the light emitting diode, and the like, are used, such that a circuit configuration may be complicated. Therefore, a circuit for full-wave rectifying AC power and connecting a plurality of light emitting diodes to the full-wave rectified AC power has mainly been used.

The following Related Art Document relates to an illumination driving apparatus using a light emitting diode. More specifically, the Related Art Document provides a light emitting diode illumination driving apparatus that includes: a light emitting diode array connected in parallel with an AC power supply, grouped into a plurality of light emitting diode groups, each including at least one light emitting diode and arranged in series with each other, and including taps, each formed between the respective light emitting diode groups and at a cathode terminal of a final light emitting diode group; a reference voltage source generating a reference voltage; and a switching unit efficiently controlling peak currents for each of the light emitting diode groups based on the reference voltage according to increases and decreases in an AC input voltage, and has high efficiency, a high power factor, and low harmonic characteristics in a wide input voltage range. However, in the Related Art Document, the light emitting diodes are controlled in uniform order, such that life spans of the light emitting diodes according to deterioration of the light emitting diodes are not considered.

RELATED ART DOCUMENT

Korean Patent No. 10-0942234

SUMMARY OF THE INVENTION

An aspect of the present invention provides an illumination driving apparatus for a light emitting diode capable of averaging deterioration of light emitting diodes by changing light emitting diodes that are turned on or off according to an increase or a decrease in an output voltage of respective periods among a plurality of preset periods, and a method thereof.

According to an aspect of the present invention, there is provided an illumination driving apparatus for a light emitting diode, the apparatus including: a light emitting unit including M number of light emitting diodes (LEDs) connected in series and driven by an output voltage rectified in a rectifying unit; an LED switch unit including N number of LED switches connected in parallel with at least N number of the M number of LEDs, respectively, the N number of LED switches being connected in series with one another; an LED switch control signal generating unit comparing the output voltage of the rectifying unit with each of the first to Nth preset reference voltages to generate N number of LED switch control signals controlling the LED switch unit; and an LED switch controlling unit transferring the N number of LED switch control signals to the LED switch unit so that turn on or turn off operations of the N number of LED switches are changed in respective N periods of the output voltage of the rectifying unit.

The LED switch controlling unit may transfer the N number of LED switch control signals to the N number of LED switches, respectively, so that the turn on or turn off operations of the N number of LED switches are performed in preset amounts within the N periods of the output voltage of the rectifying unit.

The preset amounts may be the same as each other in respective switches among the N number of LED switches.

M may be larger than or equal to N.

The LED switch controlling unit may include: a clock signal generating unit generating a clock signal having the same interval as that of the output voltage of the rectifying unit; a shift register shifting and outputting N number of pre-stored switch network control signals when the clock signal transferred from the clock signal generating unit drops from a high level signal to a low level signal; and a switch network operated by the N number of switch network control signals and providing the N number of LED switch control signals to the N number of LED switches, respectively.

The clock signal generating unit may compare the output voltage of the rectifying unit with the Nth reference voltage to generate the high level signal in a case in which the output voltage of the rectifying unit is higher than the Nth reference voltage.

The clock signal generating unit may include a comparing circuit receiving the output voltage from the rectifying unit through a non-inverting terminal thereof and receiving the Nth reference voltage through an inverting terminal thereof to generate the clock signal and output the generated clock signal to the shift register.

One of the N number of pre-stored switch network control signals may be the high level signal, and N−1 thereof may be the low level signal.

The switch network may include N number of switch stages connected to the LED switch control signal generating unit through N number of input terminals, respectively, the N number of switch stages may be connected to the LED switch unit through N number of output terminals, respectively, the N number of switch stages may include N number of switches connected in parallel with input terminals respectively connected to the N number of switch stages among the N number of input terminals, respectively, the N number of switch network control signals may be applied to the N number of switches of each of the N number of switch stages, respectively, such that one of the N number of switches of each of the N number of switch stages is turned on and N−1 switches thereof are turned off, and the N number of switch stages may transfer the LED switch control signals input from the N number of input terminals to a different N number of output terminals, respectively.

A first switch network control signal of the N number of pre-stored switch network control signals may be the high level signal and N−1 thereof except for the first switch network control signal may be the low level signals, and first to Nth input terminals of the N number of input terminals may be connected to first to Nth output terminals of the N number of output terminals, respectively, before a first drop point of the clock signal, be connected to the second to Nth output terminals and the first output terminal of the N number of output terminals, respectively, after the first drop point of the clock signal and before a second drop point of the clock signal, be sequentially connected to K+1 to Nth output terminals and the first to Kth output terminals of the N number of output terminals, respectively, after a Kth drop point of the clock signal and before a K+1-th drop point of the clock signal (K indicating a positive integer of 2 or more and N−2 or less), and be sequentially connected to the Nth output terminal and the first to N−1-th output terminals of the N number of output terminals, respectively, after an N−1-th drop point of the clock signal and before an Nth drop point of the clock signal.

The LED switch control signal generating unit may compare the output voltage of the rectifying unit with each of the first to Nth preset reference voltages to generate a low level signal turning off the LED switch in a case in which the output voltage of the rectifying unit is higher than the first to Nth preset reference voltages.

The LED switch control signal generating unit may include: a comparing unit including N number of comparators each having a non-inverting terminal to which the output voltage of the rectifying unit is applied and an inverting terminal to which each of the first to Nth reference voltages is applied, and an inverting circuit unit including N number of inverters each inverting outputs of the N number of comparators.

According to another aspect of the present invention, there is provided a method of driving illumination of a light emitting diode, the method including: (a) outputting light from M number of light emitting diodes driven by an output voltage rectified in a rectifying unit and connected in series; (b) turning N number of LED switches connected in series with one another and connected in parallel with at least N number of the M number of light emitting diodes, on or off, in response to N number of LED switch control signals; (c) comparing the output voltage of the rectifying unit with each of the first to Nth preset reference voltages to generate the N number of LED switch control signals; and (d) transferring the N number of LED switch control signals to an LED switch unit so that turn on or turn off operations of the N number of LED switches are changed in respective N periods of the output voltage of the rectifying unit.

In operation (c), the N number of LED switch control signals may be transferred to the N number of LED switches, respectively, so that the turn on or turn off operations of the N number of LED switches are performed in preset amounts within the N periods of the output voltage of the rectifying unit.

The preset amounts may be the same as each other in respective switches among the N number of LED switches.

M may be larger than or equal to N.

Operation (c) may include: (c-1) generating, in a clock signal generating unit, a clock signal having the same interval as that of the output voltage of the rectifying unit; (c-2) shifting and outputting N number of switch network control signals pre-stored in a shift resistor when the clock signal drops from a high level signal to a low level signal; and (c-3) providing, in a switch network operated by the N number of switch network control signals, the N number of LED switch control signals to the N number of LED switches, respectively.

In operation (c-1), the output voltage of the rectifying unit may be compared with the Nth reference voltage to generate the high level signal in a case in which the output voltage of the rectifying unit is higher than the Nth reference voltage.

In operation (c-1), the output voltage of the rectifying unit may be received in a comparator through a non-inverting terminal thereof and the Nth reference voltage may be received therein through an inverting terminal thereof to generate the clock signal and output the generated clock signal to the shift register.

One of the N number of pre-stored switch network control signals may be the high level signal, and N−1 thereof may be the low level signals.

wherein the switch network includes N number of switch stages receiving the LED switch control signal through N number of input terminals, respectively, the N number of switch stages may be connected to the LED switch unit through N number of output terminals, respectively, the N number of switch stages may include N number of switches connected in parallel with input terminals respectively connected to the N number of switch stages among the N number of input terminals, respectively, the N number of switch network control signals may be applied to the N number of switches of each of the N number of switch stages, respectively, such that one of the N number of switches of each of the N number of switch stages is turned on and N−1 switches thereof are turned off, and the N number of switch stages may transfer the LED switch control signals input from the N number of input terminals to a different N number of output terminals, respectively.

A first switch network control signal of the N number of pre-stored switch network control signals may be the high level signal and N−1 thereof except for the first switch network control signal may be the low level signals, and first to Nth input terminals of the N number of input terminals may be connected to first to Nth output terminals of the N number of output terminals, respectively, before a first drop point of the clock signal, be connected to the second to Nth output terminals and the first output terminal of the N number of output terminals, respectively, after the first drop point of the clock signal and before a second drop point of the clock signal, be sequentially connected to K+1 to Nth output terminals and the first to Kth output terminals of the N number of output terminals, respectively, after a Kth drop point of the clock signal and before a K+1-th drop point of the clock signal (K indicating a positive integer of 2 or more and N−2 or less), and may be sequentially connected to the Nth output terminal and the first to N−1-th output terminals of the N number of output terminals, respectively, after an N−1-th drop point of the clock signal and before an Nth drop point of the clock signal.

In operation (c), the output voltage of the rectifying unit may be compared with each of the first to Nth preset reference voltages to generate a low level signal turning off the LED switch in a case in which the output voltage of the rectifying unit is higher than the first to Nth preset reference voltages.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE EMBODIMENTS

Figure 1:
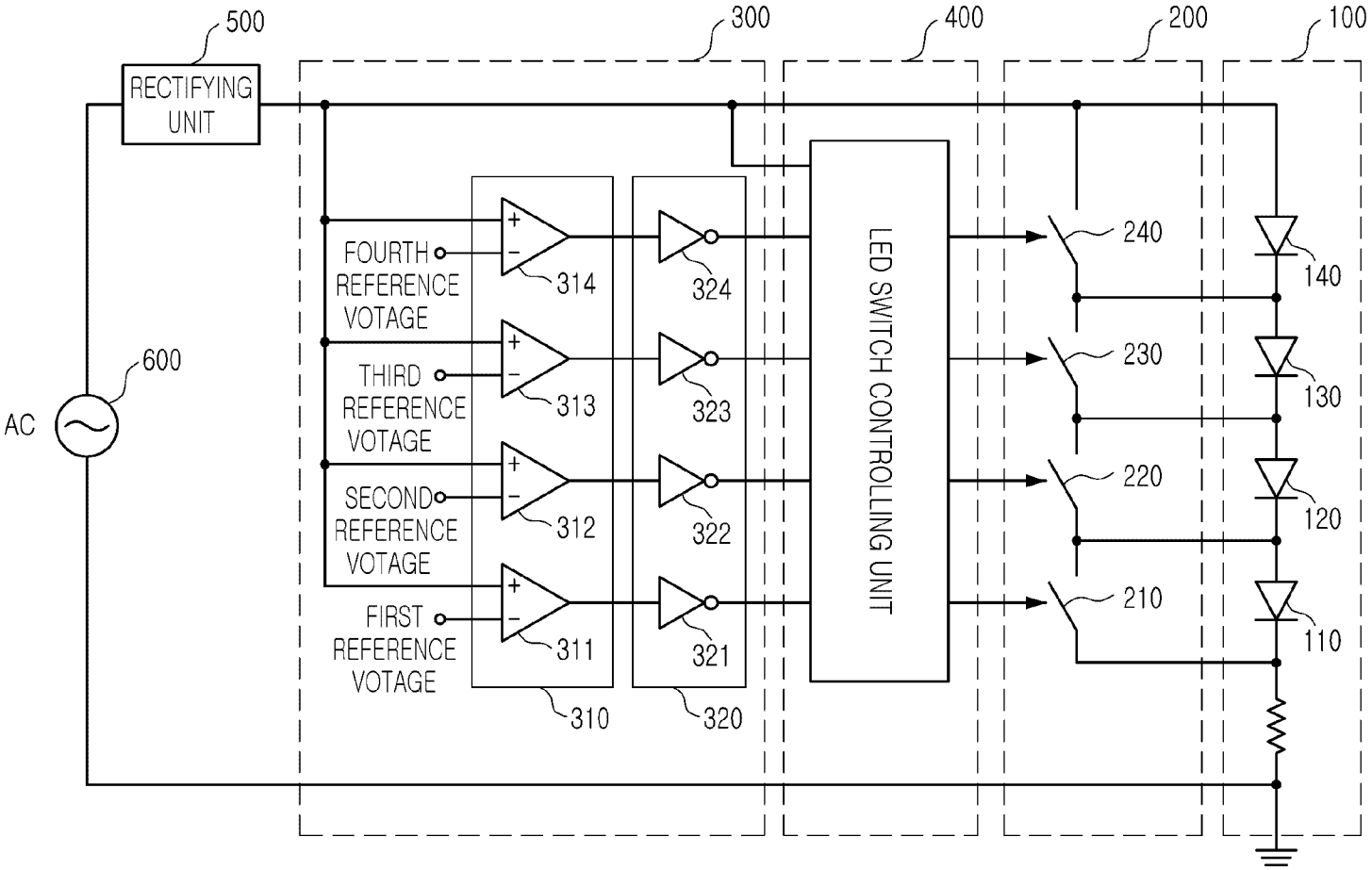
FIG. 1 is a circuit diagram showing an illumination driving apparatus for a light emitting diode according to an embodiment of the present invention.

Hereinafter, embodiments of the present invention will be described in detail with reference to the accompanying drawings. The invention may, however, be embodied in many different forms and should not be construed as being limited to the embodiments set forth herein. Rather, these embodiments are provided so that this disclosure will be thorough and complete, and will fully convey the scope of the invention to those skilled in the art.

In the drawings, the shapes and dimensions of elements may be exaggerated for clarity, and the same reference numerals will be used throughout to designate the same or like elements.

Hereinafter, embodiments of the present invention will be described in detail with reference to the accompanying drawings so that those skilled in the art may easily practice the present invention.

FIG. 1 is a circuit diagram showing an illumination driving apparatus for a light emitting diode according to an embodiment of the present invention. Referring to FIG. 1, the illumination driving apparatus for a light emitting diode according to the embodiment of the present invention may include a light emitting unit 100, a light emitting diode (LED) switch unit 200, an LED switch control signal generating unit 300, an LED switch controlling unit 400, a rectifying unit 500, and an alternating current (AC) power supply 600.

Although an embodiment in which the light emitting unit 100 includes four light emitting diodes connected in series is shown in FIG. 1, the light emitting unit 100 may include M number of light emitting diodes connected in series in another embodiment. The light emitting unit 100 may be driven by an output voltage rectified in the rectifying unit.

Although an embodiment in which the LED switch unit 200 includes four LED switches connected in series is shown in FIG. 1, the LED switch unit 200 may also include N number of LED switches connected in series. The N number of LED switches may be connected in parallel with at least N number of the M number of light emitting diodes, respectively. M may be equal to or larger than N.

Although an embodiment in which the LED switch control signal generating unit 300 includes first to fourth comparators 311 to 314 comparing the output voltage of the rectifying unit 500 with first to fourth preset reference voltages, respectively, and first to fourth inverters 321 to 324 inverting outputs of the first to fourth comparators 311 to 314, respectively, is shown in FIG. 1, the LED switch control signal generating unit 300 may also include first to Nth comparators comparing the output voltage of the rectifying unit 500 with first to Nth preset reference voltages, respectively, and first to Nth inverters inverting outputs of the first to Nth comparators.

The LED switch control signal generating unit 300 may compare the output voltage of the rectifying unit 500 with each of the first to Nth preset reference voltages to generate LED switch control signals controlling the LED switch unit 200. The LED switch controlling unit 400 may transfer the LED switch control signals transferred from the LED switch control signal generating unit 300 to the LED switch unit 200 so that turn on or turn off operations of the N number of LED switches are changed in respective N periods of the output voltage of the rectifying unit 500. The LED switch controlling unit 400 may respectively transfer the N number of LED switch control signals to the N number of LED switches so that the turn on or turn off operations of the N number of LED switches are performed in preset amounts within the N periods of the output voltage of the rectifying unit 500. The preset amounts may be the same as each other in respective switches among the N number of LED switches.

Figure 2:
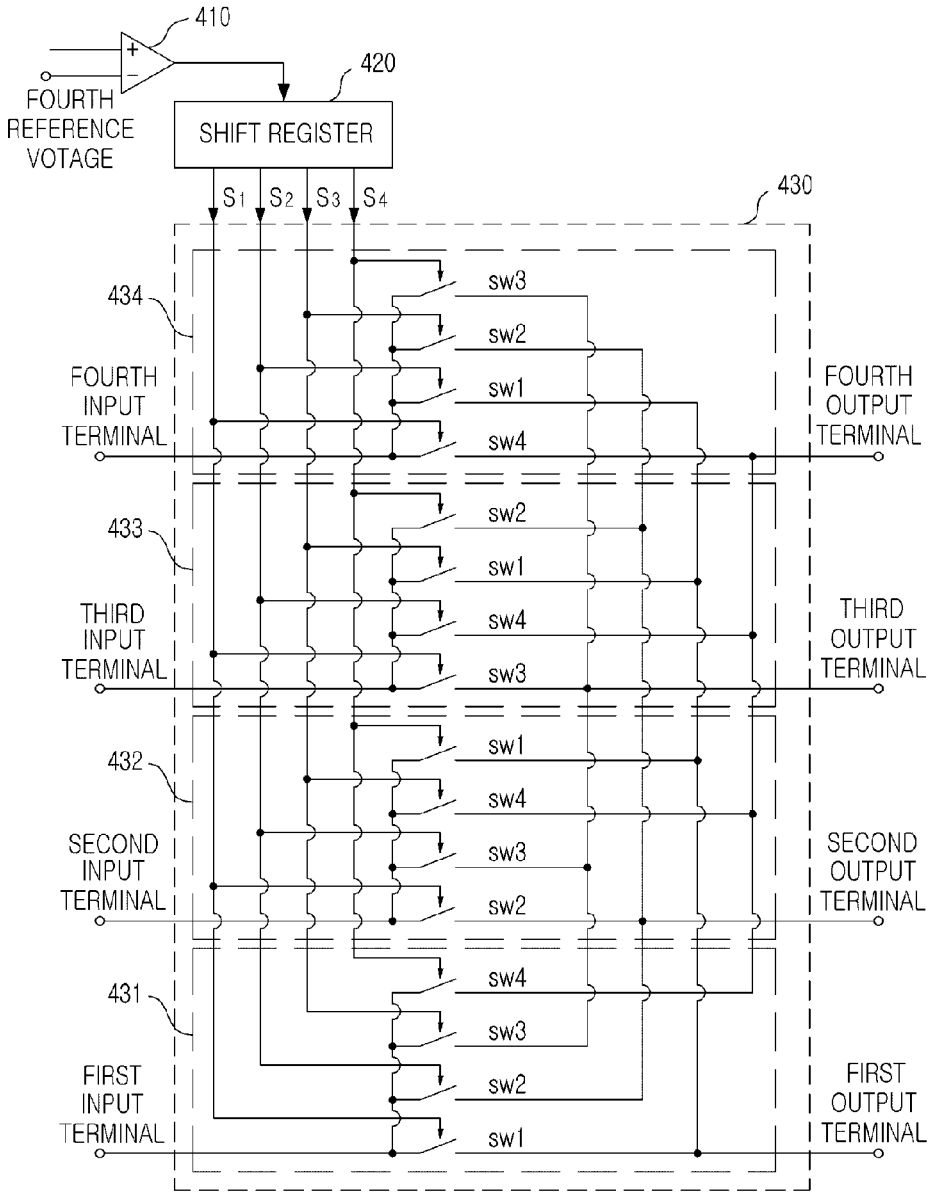
FIG. 2 is a circuit diagram showing a light emitting diode (LED) switch controlling unit according to the embodiment of the present invention in detail.

FIG. 2 is a circuit diagram showing a light emitting diode switch controlling unit 400 according to the embodiment of the present invention in detail. Referring to FIG. 2, the LED switch controlling unit 400 may include a clock signal generating unit 410, a shift register 420, and a switch network 430. The clock signal generating unit 410 may generate a clock signal having the same interval as that of the output voltage of the rectifying unit.

Although an embodiment in which the clock signal generating unit 410 compares the output voltage of the rectifying unit 500 with the fourth reference voltage is shown in FIG. 2, the clock signal generating unit 410 may also compare the output voltage of the rectifying unit 500 with the Nth preset reference voltage. The clock signal generating unit 410 may generate a high level signal in the case in which the output voltage of the rectifying unit 500 is higher than the Nth reference voltage. More specifically, the clock signal generating unit 410 may include a comparing circuit receiving the output voltage from the rectifying unit 500 through a non-inverting terminal thereof and receiving the Nth reference voltage through an inverting terminal thereof to generate the clock signal and output the generated clock signal to the shift register 420.

Although an embodiment in which the shift register 420 outputs four pre-stored switch network control signals is shown in FIG. 2, the shift register 420 may also output N number of pre-stored switch network control signals. The shift register 420 may shift and output the N number of pre-stored switch network control signals when the clock signal transferred from the clock signal generating unit 410 drops from a high level signal to a low level signal. One of the N number of pre-stored switch network control signals may be a high level signal, and N−1 thereof may be low level signals.

The switch network 430 may be operated by the N number of switch network control signals and provide the N number of switch network control signals to the N number of LED switches, respectively. Although an embodiment in which the switch network 430 includes four switch stages 431 to 434 is shown in FIG. 2, the switch network 430 may also include N number of switch stages. In addition, although an embodiment in which each of the switch stages includes four switches is shown in FIG. 2, in the case in which the number of switch stages is N, each of the switch stages may include N number of switches. Further, although an embodiment in which the switch network 430 includes four input terminals and four output terminals is shown in FIG. 2, in the case in which the number of switch stages is N, the switch network 430 may include N number of input terminals and N number of output terminals.

The switch network 430 may include N number of switch stages connected to the LED switch control signal generating unit 300 through the N number of input terminals, respectively, wherein the N number of switch stages may be connected to the LED switch unit 200 through the N number of output terminals, respectively. The N number of switch stages may include N number of switches connected in parallel with input terminals respectively connected to the N number of switch stages among the N number of input terminals, respectively.

The N number of switch network control signals may be applied to the N number of switches of each of the N number of switch stages, respectively. In the case in which one of the N number of pre-stored switch network control signals is a high level signal and N−1 thereof are low level signals, one of the N number of switches of each of the N number of switch stages may be turned on and N−1 switches thereof may be turned off.

Figures 3A, 3B, 3C:
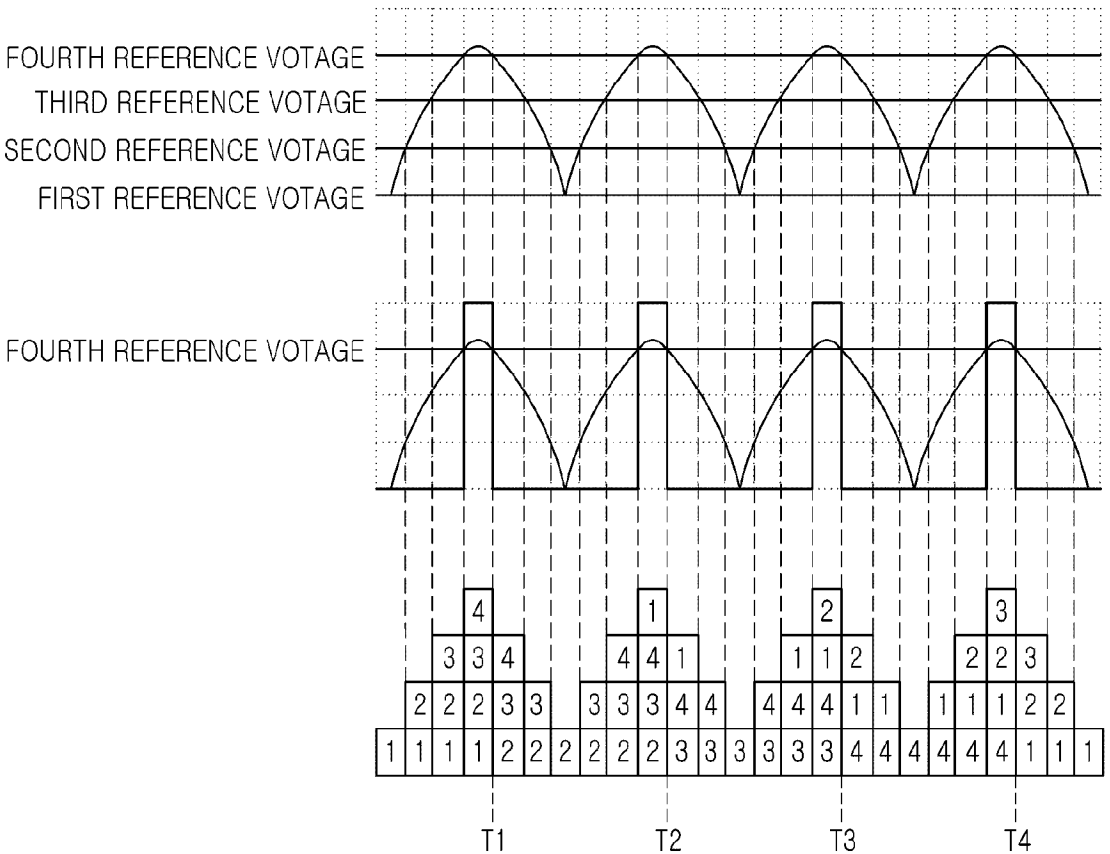
FIG. 3A is a diagram showing an output voltage of a rectifying unit according to the embodiment of the present invention and preset reference voltages.
FIG. 3B is a diagram showing a clock signal generated in a clock signal generating unit according to the embodiment of the present invention.
FIG. 3C is a diagram describing a light emitting diode driven according to an increase or a decrease in the output voltage of the rectifying unit according to the embodiment of the present invention.

FIG. 3A is a diagram showing an output voltage of a rectifying unit according to the embodiment of the present invention and preset reference voltages; FIG. 3B is a diagram showing a clock signal generated in a clock signal generating unit according to the embodiment of the present invention; and FIG. 3C is a diagram describing a light emitting diode driven according to an increase or a decrease in the output voltage of the rectifying unit according to the embodiment of the present invention. Referring to FIGS. 1 through 3C, an operation of the illumination driving apparatus for a light emitting diode will be described in detail.

The output voltage of the rectifying unit 500 may be input to the LED switch control signal generating unit 300. More specifically, the output voltage of the rectifying unit 500 may be input to non-inverting terminals of the first to fourth comparators 311 to 314 of the comparing unit 310. The first preset reference voltage may be input to an inverting terminal of the first comparator 311, the second preset reference voltage may be input to an inverting terminal of the second comparator 312, the third preset reference voltage may be input to an inverting terminal of the third comparator 313, and the fourth preset reference voltage may be input to an inverting terminal of the fourth comparator 314.

Referring to FIG. 3A, since the first preset reference voltage is lower than or equal to the output voltage of the rectifying unit 500, the first comparator 311 may always output a high level signal. The first comparator may be replaced by an inverter connected to a ground. The second to fourth comparators 312 to 314 may output a high or low level signal according to an increase or a decrease in the output voltage of the rectifying unit 500. The outputs of the first to fourth comparators 311 to 314 are inverted by the first to fourth inverters 321 to 324, respectively, such that the LED switch control signals may be generated. The generated LED switch control signals may be transferred to the LED switch controlling unit 400.

Referring to FIGS. 2 and 3B, the clock signal generating unit 410 of the LED switch controlling unit 400 may compare the fourth preset reference voltage with the output voltage of the rectifying unit 500 to generate the clock signal. More specifically, the clock signal generating unit 410 may generate a high level clock signal in the case in which the output voltage of the rectifying unit 500 is higher than the fourth preset reference voltage and generate a low level clock signal in the case in which the output voltage of the rectifying unit 500 is lower than the fourth preset reference voltage. The clock signals may be provided to the shift register 420. Four switch network control signals may be pre-stored in the shift register 420. One of the four pre-stored switch network control signals may be a high level signal, and three thereof may be low level signals.

Referring to FIGS. 1 through 3C, in the case in which the output voltage of the rectifying unit 500 is lower than or equal to the second reference voltage, the low level signal may be input to the first input terminal of the switch network and the high level signal may be input to the second to fourth input terminals of the switch network. In this case, the clock signal generating unit 410 may generate a low level clock signal, and the shift register 420 receiving the low level clock signal may output the pre-stored switch network control signal as it is.

Hereinafter, it will be assumed that a first pre-stored switch network control signal S1 is a high level signal and second to fourth pre-stored switch network control signals S2 to S4 are low level signals. In the case in which the first pre-stored switch network control signal S1 is the high level signal and second and the fourth pre-stored switch network control signals S2 to S4 are the low level signals, SW1 of the first switch stage 431 of the switch network 430 is turned on, SW2 of the second switch stage 432 of the switch network 430 is turned on, SW3 of the third switch stage 433 of the switch network 430 is turned on, and SW4 of the fourth switch stage 434 of the switch network 430 is turned on, such that the first input terminal of the switch network may be connected to the first output terminal, the second input terminal of the switch network may be connected to the second output terminal, the third input terminal of the switch network may be connected to the third output terminal, and the fourth input terminal of the switch network may be connected to the fourth output terminal.

Therefore, the LED switch control signals input to the first to fourth input terminals may be output to the first to fourth output terminals, respectively, to thereby be applied to the first to fourth LED switches, respectively. Therefore, the first LED switch is turned off and the second to fourth LED switches are turned on, such that the first light emitting diode 110 may be turned on.

Since the shift register 420 shifts the pre-stored switch network control signals when the clock signal of the clock signal generating unit 410 drops from the high level signal to the low level signal, the first to fourth input terminals of the switch network 430 may be connected to the first to fourth output terminals, respectively, before a point in time T1 corresponding to a first drop point of the clock signal. Therefore, in the case in which the output voltage of the rectifying unit 500 is higher than the second reference voltage and is lower than or equal to the third reference voltage, the first and second light emitting diodes may be turned on, in the case in which the output voltage of the rectifying unit 500 is higher than the third reference voltage and is lower than or equal to the fourth reference voltage, the first to third light emitting diodes may be turned on, and in the case in which the output voltage of the rectifying unit 500 is higher than the fourth reference voltage, the first to fourth light emitting diodes may be turned on.

At the point in time T1, since the clock signal of the clock signal generating unit 410 drops from the high level signal to the low level signal, the shift register 420 may shift the pre-stored switch network control signals bit by bit and output the shifted pre-stored switch network control signals. Therefore, the second switch network control signal S2 may be the high level signal, and remaining switch network control signals may be the low level signals. Since the second switch network control signal S2 is the high level signal, SW2 of the first switch stage 431 of the switch network 430 is turned on, SW3 of the second switch stage 432 of the switch network 430 is turned on, SW4 of the third switch stage 433 of the switch network 430 is turned on, and SW1 of the fourth switch stage 434 of the switch network 430 is turned on, such that the first input terminal of the switch network may be connected to the second output terminal, the second input terminal of the switch network may be connected to the third output terminal, the third input terminal of the switch network may be connected to the fourth output terminal, and the fourth input terminal of the switch network may be connected to the first output terminal.

Therefore, after the point in time T1 and before a point in time T2, in the case in which the output voltage of the rectifying unit 500 is higher than the first reference voltage and is lower than or equal to the second reference voltage, the third light emitting diode may be turned on, in the case in which the output voltage of the rectifying unit 500 is higher than the second reference voltage and is lower than or equal to the third reference voltage, the second and third light emitting diodes may be turned on, in the case in which the output voltage of the rectifying unit 500 is higher than the third reference voltage and is lower than or equal to the fourth reference voltage, the second to fourth light emitting diodes may be turned on, and in the case in which the output voltage of the rectifying unit 500 is higher than the fourth reference voltage, the first to fourth light emitting diodes may be turned on. After the point in time T2 and before a point in time T3, and after the point in time T3 and before a point in time T4, the illumination driving apparatus for a light emitting diode may be operated in the same scheme as a scheme in which it is operated before the point in time T1 and after the point in time T1 and before the point in time T2. Therefore, the light emitting diodes that are turned on are changed according to the increase or the decrease in the output voltage of the rectifying unit 500 per each period of the output voltage of the rectifying unit 500, whereby deterioration of the light emitting diodes may be averaged.

FIGS. 1 through 3 are diagrams showing an embodiment in which the light emitting diodes that are turned on are changed according to the increase or the decrease in the output voltage per each of the four periods of the output voltage of the rectifying unit 500. The present invention is not limited thereto. That is, the light emitting diodes that are turned on may also be changed according to the increase or the decrease in the output voltage in respective N periods of the output voltage of the rectifying unit 500. Here, N may be a natural number of 2 or more.

In addition, according to an embodiment of the present invention, a method of driving illumination of alight emitting diode capable of preventing deterioration of light emitting diodes may be provided. The method of driving illumination of a light emitting diode may include (a) outputting light from M number of light emitting diodes (LEDs) driven by an output voltage rectified in a rectifying unit and connected in series, (b) turning N number of LED switches connected in parallel with at least N number of the M number of light emitting diodes and connected in series with one another, on or off, in response to N number of LED switch control signals, (c) comparing the output voltage of the rectifying unit with each of the first to Nth preset reference voltages to generate the N number of LED switch control signals, and (d) transferring the N number of LED switch control signals to the LED switch unit so that turn on or turn off operations of the N number of LED switches are changed in respective N periods of the output voltage of the rectifying unit.

In operation (c), the N number of LED switch control signals may be transferred to the N number of LED switches, respectively, so that the turn on or turn off operations of the N number of LED switches are performed in preset amounts within the N periods of the output voltage of the rectifying unit.

Operation (c) may include generating, in a clock signal generating unit, a clock signal having the same interval as that of the output voltage of the rectifying unit, shifting and outputting N number of switch network control signals prestored in a shift resistor when the clock signal drops from a high level signal to a low level signal, and providing, in a switch network operated by the N number of switch network control signals, the N number of LED switch control signals to the N number of LED switches, respectively.

Since other configurations and functions of the clock signal generating unit 410, the shift register 420, and the switch network 430 are the same as those of FIGS. 1 to 3, a detailed descriptions thereof will be omitted.

As set forth above, according to the embodiments of the present invention, the light emitting diodes that are turned on or off are controlled to be changed according to the increase or the decrease in the output voltage per each of a plurality of preset periods to average the deterioration of the plurality of light emitting diodes, whereby life spans of the light emitting diodes may be increased.

While the present invention has been shown and described in connection with the embodiments, it will be apparent to those skilled in the art that modifications and variations can be made without departing from the spirit and scope of the invention as defined by the appended claims.

What is claimed is:

1. An illumination driving apparatus for a light emitting diode, the apparatus comprising:

a light emitting unit including M number of light emitting diodes (LEDs) connected in series and driven by an output voltage rectified in a rectifying unit;

an LED switch unit including N number of LED switches connected in parallel with at least N number of the M number of LEDs, respectively, the N number of LED switches being connected in series with one another;

an LED switch control signal generating unit comparing the output voltage of the rectifying unit with each of the first to Nth preset reference voltages to generate N number of LED switch control signals controlling the LED switch unit; and an LED switch controlling unit transferring the N number of LED switch control signals to the LED switch unit so as to change turn on or turn off operations of the N number of LED switches in respective N periods of the output voltage of the rectifying unit.

2. The apparatus of claim 1, wherein the LED switch controlling unit transfers the N number of LED switch control signals to the N number of LED switches, respectively, so that the turn on or turn off operations of the N number of LED switches are performed in preset amounts within the N periods of the output voltage of the rectifying unit.

3. The apparatus of claim 2, wherein the preset amounts are the same as each other in respective switches among the N number of LED switches.

4. The apparatus of claim 1, wherein M is higher than or equal to N.

5. The apparatus of claim 1, wherein the LED switch controlling unit includes:

a clock signal generating unit generating a clock signal having the same interval as that of the output voltage of the rectifying unit;

a shift register shifting and outputting N number of pre-stored switch network control signals when the clock signal transferred from the clock signal generating unit drops from a high level signal to a low level signal; and a switch network operated by the N number of switch network control signals and providing the N number of LED switch control signals to the N number of LED switches, respectively.

6. The apparatus of claim 5, wherein the clock signal generating unit compares the output voltage of the rectifying unit with the Nth reference voltage to generate the high level signal in a case in which the output voltage of the rectifying unit is higher than the Nth reference voltage.

7. The apparatus of claim 5, wherein the clock signal generating unit includes a comparing circuit receiving the output voltage from the rectifying unit through a non-inverting terminal thereof and receiving the Nth reference voltage through an inverting terminal thereof to generate the clock signal and output the generated clock signal to the shift register.

8. The apparatus of claim 5, wherein one of the N number of pre-stored switch network control signals is the high level signal, and N−1 thereof are the low level signals.

9. The apparatus of claim 5, wherein the switch network includes N number of switch stages connected to the LED switch signal generating unit through N number of input terminals, respectively, the N number of switch stages are connected to the LED switch unit through N number of output terminals, respectively, the N number of switch stages include N number of switches connected in parallel with input terminals respectively connected to the N number of switch stages among the N number of input terminals, respectively, the N number of switch network control signals are applied to the N number of switches of each of the N number of switch stages, respectively, such that one of the N number of switches of each of the N number of switch stages is turned on and N−1 switches thereof are turned off, and the N number of switch stages transfer the LED switch control signals input from the N number of input terminals to a different N number of output terminals, respectively.

10. The apparatus of claim 9, wherein a first switch network control signal of the N number of pre-stored switch network control signals is the high level signal and N−1 thereof except for the first switch network control signal are the low level signals, and first to Nth input terminals of the N number of input terminals are connected to first to Nth output terminals of the N number of output terminals, respectively, before a first drop point of the clock signal, are connected to the second to Nth output terminals and the first output terminal of the N number of output terminals, respectively, after the first drop point of the clock signal and before a second drop point of the clock signal, are sequentially connected to K+1 to Nth output terminals and the first to Kth output terminals of the N number of output terminals, respectively, after a Kth drop point of the clock signal and before a K+1-th drop point of the clock signal (K being a positive integer of 2 or more and N−2 or less), and are sequentially connected to the Nth output terminal and the first to N−1-th output terminals of the N number of output terminals, respectively, after an N−1-th drop point of the clock signal and before an Nth drop point of the clock signal.

11. The apparatus of claim 1, wherein the LED switch control signal generating unit compares the output voltage of the rectifying unit with each of the first to Nth preset reference voltages to generate a low level signal turning off the LED switch in a case in which the output voltage of the rectifying unit is higher than the first to Nth preset reference voltages.

12. The apparatus of claim 1, wherein the LED switch control signal generating unit includes:

a comparing unit including N number of comparators each having a non-inverting terminal to which the output voltage of the rectifying unit is applied and an inverting terminal to which each of the first to Nth reference voltages is applied, and an inverting circuit unit including N number of inverters each inverting outputs of the N number of comparators.

13. A method of driving illumination of a light emitting diode, the method comprising:

(a) outputting light from M number of light emitting diodes driven by an output voltage rectified in a rectifying unit and connected in series;

(b) turning N number of LED switches connected in series with one another and connected in parallel with at least N number of the M number of light emitting diodes, on or off, in response to N number of LED switch control signals;

(c) comparing the output voltage of the rectifying unit with each of the first to Nth preset reference voltages to generate the N number of LED switch control signals; and (d) transferring the N number of LED switch control signals to an LED switch unit so as to change turn on or turn off operations of the N number of LED switches in respective N periods of the output voltage of the rectifying unit.

14. The method of claim 13, wherein in operation (c), the N number of LED switch control signals are transferred to the N number of LED switches, respectively, so that the turn on or turn off operations of the N number of LED switches are performed in preset amounts within the N periods of the output voltage of the rectifying unit.

15. The method of claim 14, wherein the preset amounts are the same as each other in respective switches among the N number of LED switches.

16. The method of claim 13, wherein M is higher than or equal to N.

17. The method of claim 13, wherein operation (c) includes:

(c-1) generating, in a clock signal generating unit, a clock signal having the same interval as that of the output voltage of the rectifying unit;

(c-2) shifting and outputting N number of switch network control signals pre-stored in a shift resistor when the clock signal drops from a high level signal to a low level signal; and (c-3) providing, in a switch network operated by the N number of switch network control signals, the N number of LED switch control signals to the N number of LED switches, respectively.

18. The method of claim 17, wherein in operation (c-1), the output voltage of the rectifying unit is compared with the Nth reference voltage to generate the high level signal in a case in which the output voltage of the rectifying unit is higher than the Nth reference voltage.

19. The method of claim 17, wherein in operation (c-1), the output voltage of the rectifying unit is received in a comparator through a non-inverting terminal thereof and the Nth reference voltage is received therein through an inverting terminal thereof to generate the clock signal and output the generated clock signal to the shift register.

20. The method of claim 17, wherein one of the N number of pre-stored switch network control signals is the high level signal, and N−1 thereof are the low level signals.

21. The method of claim 17, wherein the switch network includes N number of switch stages receiving the LED switch control signal through N number of input terminals, respectively, the N number of switch stages are connected to the LED switch unit through N number of output terminals, respectively, the N number of switch stages include N number of switches connected in parallel with input terminals respectively connected to the N number of switch stages among the N number of input terminals, respectively, the N number of switch network control signals are applied to the N number of switches of each of the N number of switch stages, respectively, such that one of the N number of switches of each of the N number of switch stages is turned on and N−1 switches thereof are turned off, and the N number of switch stages transfer the LED switch control signals input from the N number of input terminals to a different N number of output terminals, respectively.

22. The method of claim 21, wherein a first switch network control signal of the N number of pre-stored switch network control signals is the high level signal and N−1 thereof except for the first switch network control signal are the low level signals, and first to Nth input terminals of the N number of input terminals are connected to first to Nth output terminals of the N number of output terminals, respectively, before a first drop point of the clock signal, are connected to the second to Nth output terminals and the first output terminal of the N number of output terminals, respectively, after the first drop point of the clock signal and before a second drop point of the clock signal, are sequentially connected to K+1 to Nth output terminals and the first to Kth output terminals of the N number of output terminals, respectively, after a Kth drop point of the clock signal and before a K+1-th drop point of the clock signal (K indicating a positive integer of 2 or more and N−2 or less), and are sequentially connected to the Nth output terminal and the first to N−1-th output terminals of the N number of output terminals, respectively, after an N−1-th drop point of the clock signal and before an Nth drop point of the clock signal.

23. The method of claim 13, wherein in operation (c), the output voltage of the rectifying unit is compared with each of the first to Nth preset reference voltages to generate a low level signal turning off the LED switch in a case in which the output voltage of the rectifying unit is higher than the first to Nth preset reference voltages.

* * * * *